US005927836A

United States Patent [19]

Herr et al.

[11] Patent Number: 5,927,836

[45] Date of Patent: Jul. 27, 1999

[54] TOP COVER FASTENER

[75] Inventors: Joel L. Herr; Troy A. Johnson; David L. Ringgenberg, all of Newton, Iowa

[73] Assignee: Maytag Corporation, Newton, Iowa

[21] Appl. No.: 08/837,773

[22] Filed: Apr. 22, 1997

[51] Int. Cl.[6] ..... A47B 95/02

[52] U.S. Cl. ..... 312/244; 312/263; 312/228; 16/124

[58] Field of Search ..... 312/290, 263, 312/109, 228, 229, 244, 283, 293.1; 16/110 R, 110.5, 114 R, 124; 220/752, 756, 759, 768, 770, 772, 775; 68/3 R

[56] References Cited

U.S. PATENT DOCUMENTS

| | | | |
|---|---|---|---|
| 3,062,608 | 11/1962 | Magaline | 312/228 X |
| 3,666,340 | 5/1972 | Albeanese, III | 312/283 |
| 4,093,327 | 6/1978 | Linger | 312/244 |
| 4,153,314 | 5/1979 | Prater | 312/244 X |
| 4,288,134 | 9/1981 | Knaack et al. | 312/290 |
| 4,928,204 | 5/1990 | Wang | 220/756 X |
| 4,936,117 | 6/1990 | Kabeya | 312/228 X |
| 4,988,149 | 1/1991 | Mulder et al. | 312/228 X |
| 5,067,938 | 11/1991 | Uchida et al. | 68/3 R X |
| 5,134,754 | 8/1992 | Vickers | 16/124 |
| 5,611,609 | 3/1997 | Katz et al. | 312/263 |
| 5,711,170 | 1/1998 | Johnson | 68/3 R |

OTHER PUBLICATIONS

Sketches of Handle for Silicon Graphics box (No Date, Admitted Prior Art).

*Primary Examiner*—Peter M. Cuomo
*Assistant Examiner*—James O. Hansen
*Attorney, Agent, or Firm*—Zarley, McKee, Thomte, Voorhees & Sease

[57] ABSTRACT

A fastener is provided for securing the top cover to the cabinet of a laundry appliance. The fastener doubles as a handle. The fastener includes a first fastener member mounted to the top cover and a second fastener member extending through an opening in the cabinet and being secured to the first fastener member. A recessed portion in the second fastener member defines a hand grip for facilitating movement of the appliance.

13 Claims, 4 Drawing Sheets

10
20
3
22
14
12
26
16
18
3

20
43
36
38
42
28
32
14
12
26
44
42
34
32

50
30
58
48
48
54
60

TOP COVER FASTENER

BACKGROUND OF THE INVENTION

Laundry appliances, such as clothes washers and dryers, typically have a lower cabinet member with four vertical side walls and a top cover mounted on the cabinet. There is a need in the industry for an improved fastener for securing the top cover to the cabinet, particularly in a clothes washer having an integral tub and cabinet structure, such as that disclosed in U.S. Pat. No. 5,526,657.

Prior art appliances also normally do not have any form of a handle so that the appliance can be more easily moved.

Therefore, a primary objective of the present invention is the provision of a laundry appliance having an improved fastener for securing the top cover to the cabinet.

Another objective of the present invention is the provision of an improved laundry appliance having handles.

Another objective of the present invention is the provision of a laundry appliance having a fastener for securing the top cover to the cabinet, with the fastener also providing hand grips on the appliance.

A further objective of the present invention is the provision of a fastener for securing the top cover to a cabinet in a laundry appliance which is quick and easy to install and which securely connects the top cover to the cabinet.

Another objective of the present invention is the provision of a fastener handle for a laundry appliance which is durable and safe in use, and economical to manufacture.

These and other objectives will become apparent from the following description of the invention.

SUMMARY OF THE INVENTION

A fastener is provided for securing a top cover to the cabinet of a laundry appliance. The fastener also functions as a handle. The fastener includes an inner member which is connected to an outer member of the fastener. The outer member includes an outer peripheral face disposed on the outer surface of the cabinet and a recessed portion extending inwardly through an opening in the cabinet for securement to the inner member on the inside of the cabinet. After the inner and outer members are secured together in the cabinet opening, the top cover is matingly fit into the cabinet and secured by a snap fit to the fastener. The fastener is provided on opposite sides of the appliance, and serves as a handle for facilitating movement of the appliance.

In an alternative embodiment, a single piece fastener snap fits into aligned openings on the assembled top cover and cabinet to secure the top cover to the cabinet.

DETAILED DESCRIPTION OF THE DRAWINGS

Figure 4:
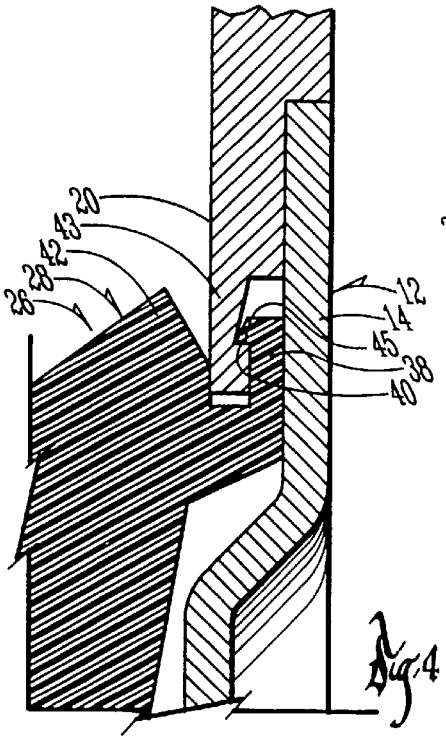
FIG. 4 is an enlarged sectional view taken along line 4—4 of FIG. 3.
Figure 3:
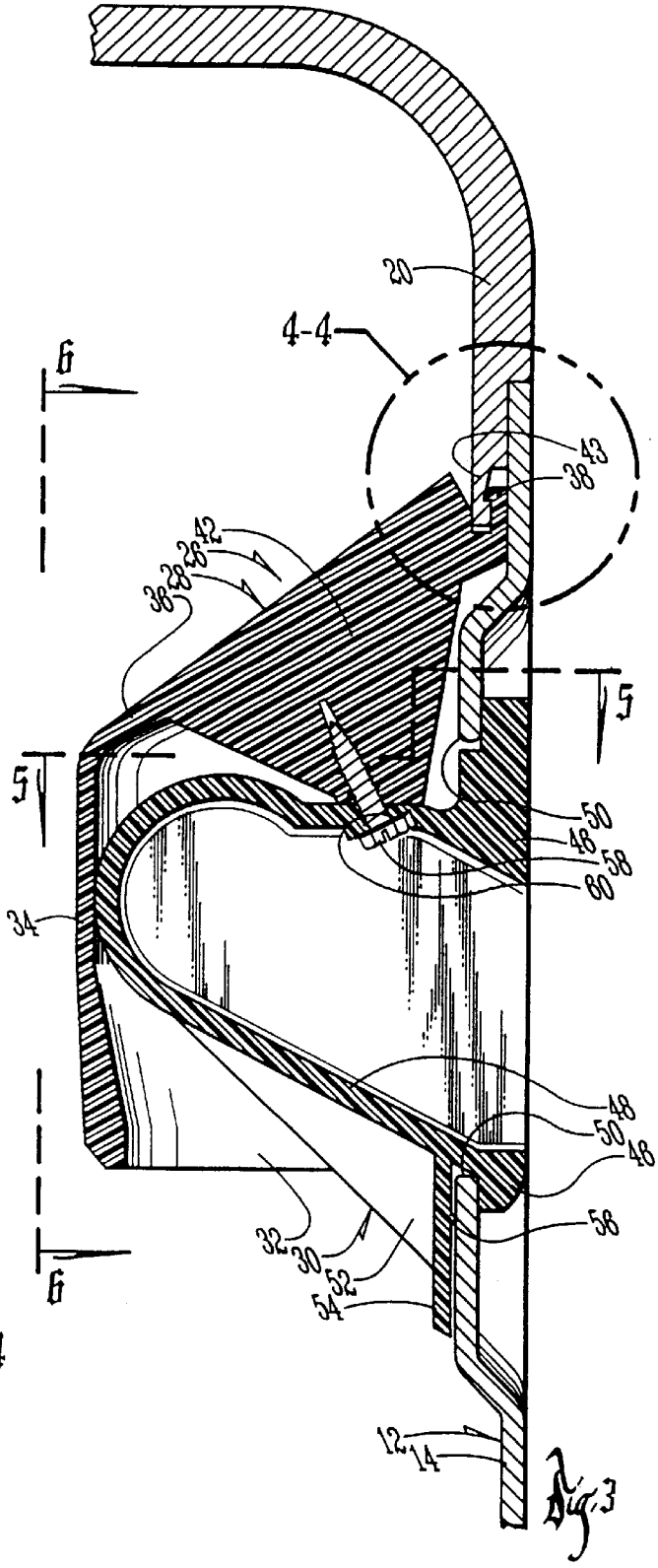
FIG. 3 is a sectional view of the fastener mounted on the appliance.
Figure 5:
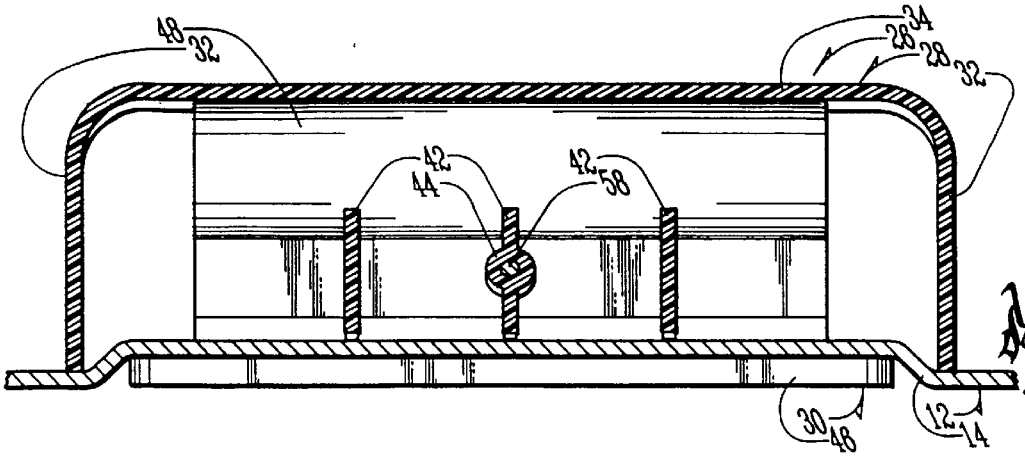
FIG. 5 is a sectional view taken along lines 5—5 of FIG. 3.
Figure 6:
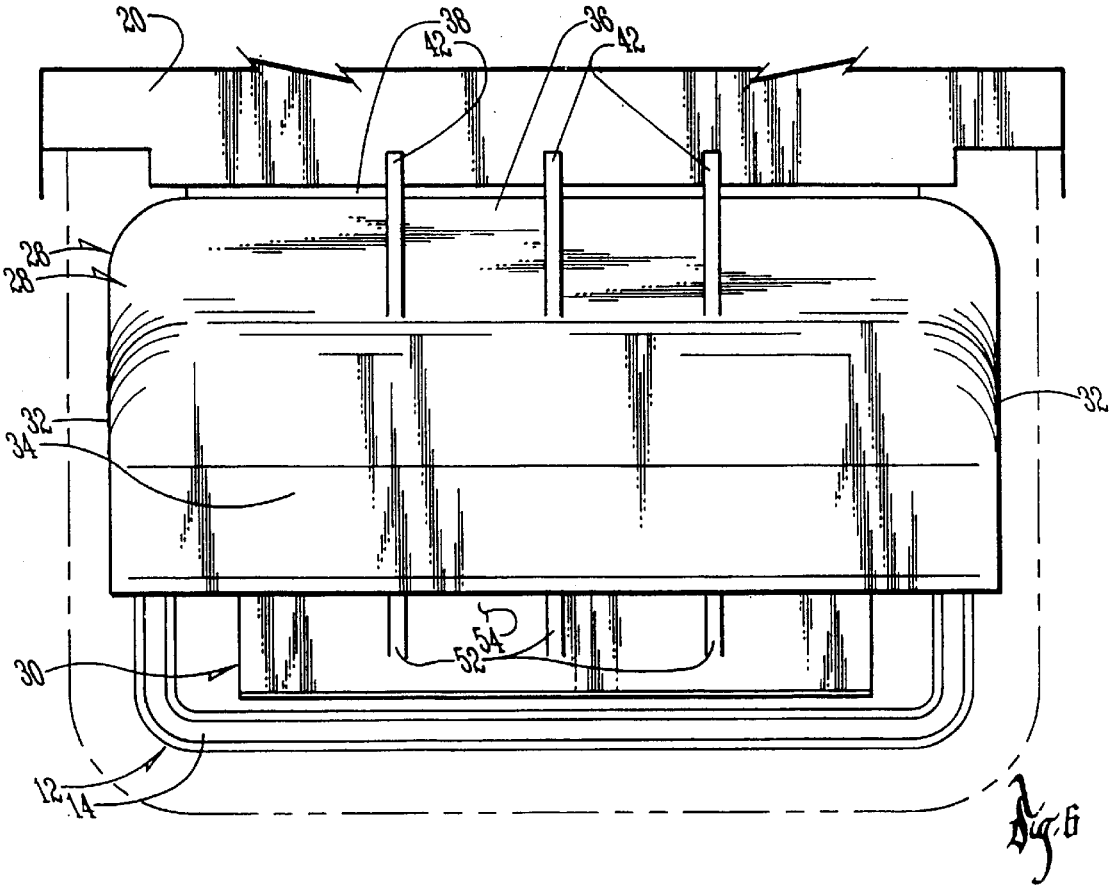
FIG. 6 is an elevational view taken along lines 6—6 FIG. 3.

With reference to the drawings, the present invention is directed towards a laundry appliance 10, such as a clothes washer or dryer. The appliance 10 includes a cabinet 12 having opposite side walls 14, a front wall 16, and a rear wall. The cabinet 12 includes a door 18 for providing access into the basket (not shown) rotatably mounted within the cabinet 12. A top cover 20 fits over the cabinet 12 and has a control panel 22 for operating the appliance 10. As best seen in FIGS. 3 and 4, the top cover 20 matingly fits within the open top of the cabinet 12.

Figures 1, 2:
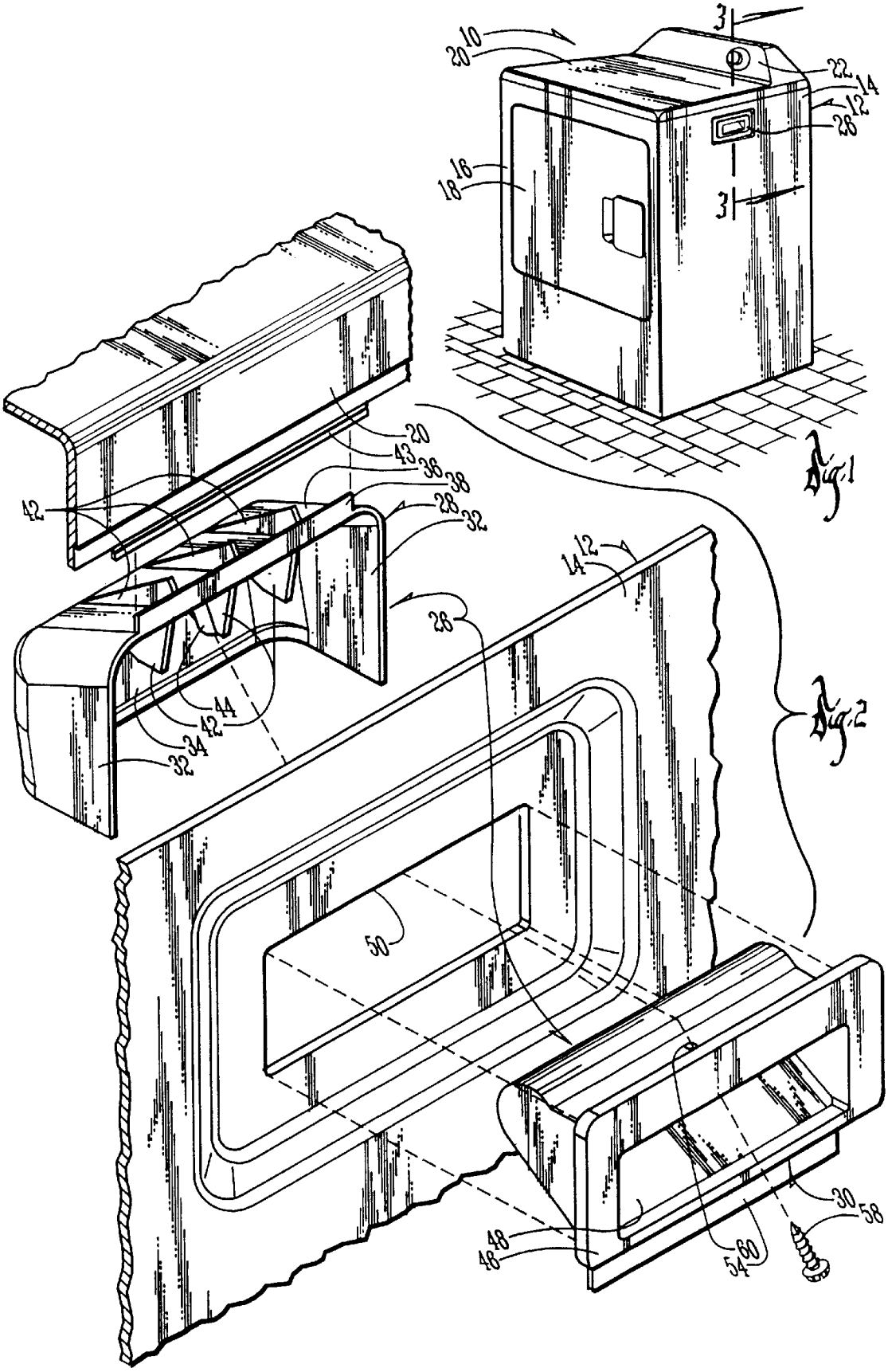
FIG. 1 is a perspective view of a laundry appliance having the fastener of the present invention.
FIG. 2 is an exploded perspective view taken along lines 2—2 of FIG. 1.

The present invention is directed towards a fastener 26 for securing the top cover 20 to the cabinet 12. Preferably, a fastener 26 is provided on the opposite side walls 14 of the appliance 10. The fastener includes an inner member 28 and an outer member 30. As best seen in FIG. 2, the inner member 28 includes opposite end walls 32, a back wall 34, and a top wall 36. Extending upwardly from the top wall 36 is a lip 38 having a catch 40 thereon. A plurality of ribs 42 provide structural rigidity to the inner fastener member 28. A boss 44 is provided on the inner fastener member 28.

The lip 38 of the inner fastener member 28 is sandwiched between a downwardly extending leg 43 of the top cover and the side wall 14 of the cabinet 12, as shown in FIGS. 3 and 4. The catch 40 of the lip 38 of the inner fastener member 28 is snap fit over a similar catch 45 on the leg 43 of the top cover 20. Thus, the catches 40 and 45 are snap fit together to secure the top cover 20 to the inner fastener member 28, after the inner member 28 is connected to the outer member 30, as described below.

The outer fastener member 30 includes a peripheral face 46 the back of which engages the outer surface of the cabinet side wall 14, as best seen in FIG. 3. The outer fastener member 30 has a recessed portion 48 which extends through an opening 50 in the side wall 14 of the cabinet 12. The outer fastener member 30 also includes a plurality of ribs 52 to enhance the rigidity of the member 30. A lower flange 54 extends downwardly from the recessed portion 48 and is spaced slightly apart from the face 46, as seen in FIG. 3. The lower peripheral edge of the opening 50 in the side wall 14 is adapted to be received between the flange 54 and the peripheral face 46 of the outer fastener member 30. A bead 56 on the flange 54 provides for a tight frictional fit between the side wall 14 and the outer fastener member 30. While the drawings show the side wall 14 of the cabinet 12 as having a recess such that the peripheral face 46 of the outer fastener member 30 is flush with the general vertical plane of the side wall 14, such a flush mounting of the fastener 26 is a preferred embodiment, though not critical.

A screw 58 is adapted to extend through a hole 60 in the outer fastener member 30 for threaded receipt in the boss 44 of the inner fastener member 28, thereby securing the inner fastener member 28 to the outer fastener member 30. When the inner and outer fastener members 28, 30 are assembled and the top cover 20 is snap fit into the inner member 28, the recessed portion 48 provides a handle or hand grip to facilitate movement of the appliance 10. Other means can be used to connect the inner member 28 to the outer member 30, such as a snap, a clip, adhesives, welds, or a bolt, as opposed to the screw 58.

In assembling the fasteners 26 of the present invention, the top cover 20 is not positioned on the cabinet 12. The outer fastener member 30 is inserted partially through the opening 50 in the side wall 14 of the cabinet 12, with the flange 54 residing behind the side wall 14 adjacent the lower edge of the opening 50 and with the peripheral face 46 of the outer fastener member 30 engaging the outer surface of the side wall 14 of the cabinet 12. With the hole 60 of the outer fastener member 30 aligned with the boss 44 of the inner fastener member 28, the screw 58 is threaded into the boss 44 so as to securely retain the fastener 26 in position on the cabinet 12. The top cover is then positioned on the cabinet 12 such that the catches 40 and 45 overlappingly and retentively snap fit together to secure the top cover 20 to the cabinet 12.

Figure 7:
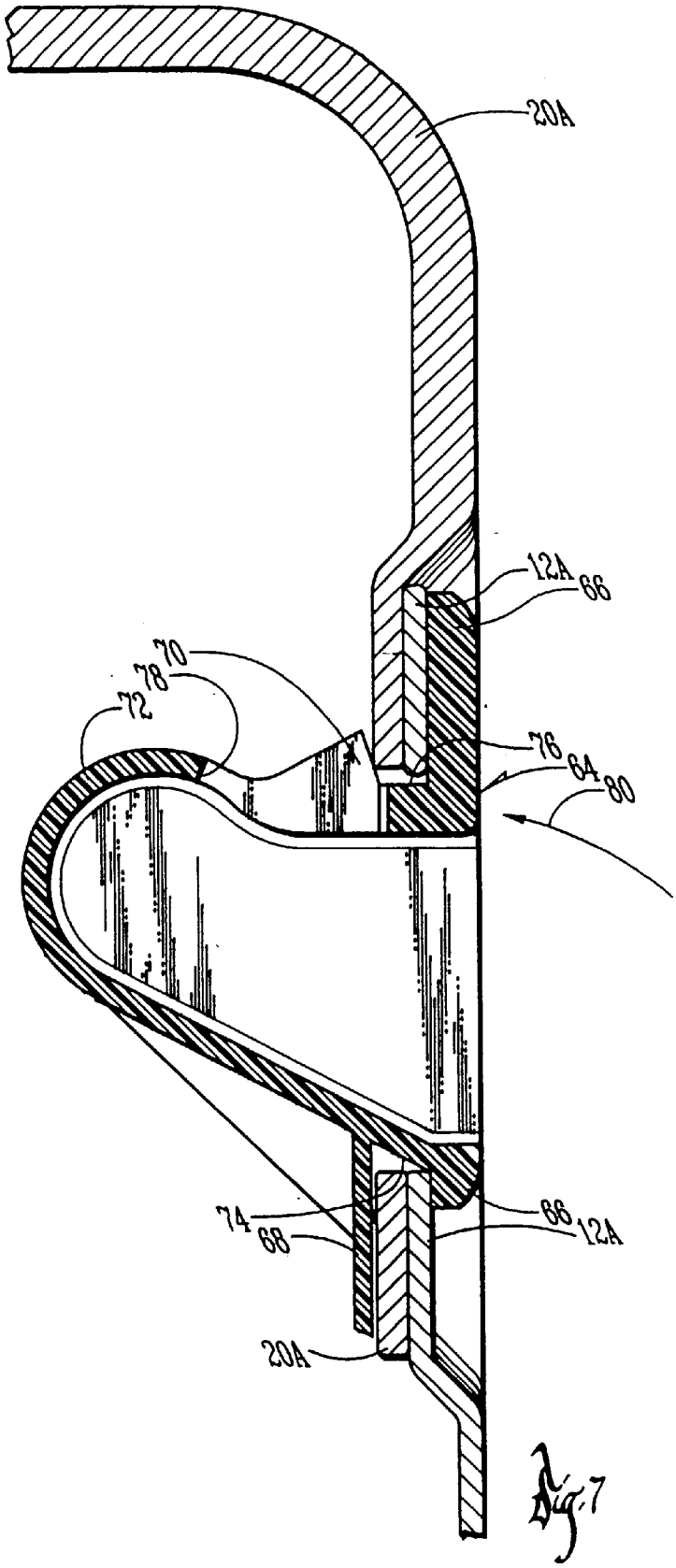
FIG. 7 is a sectional view of an alternative fastener of the present invention.

FIG. 7 shows an alternative embodiment of a fastener 64 which can be used to secure the top cover 20 to the cabinet 12, while also serving as a handle. The fastener 64 has a one-piece construction. The fastener 64 includes an outer perimeter flange 66, a lower inner flange 68 extending along the bottom edge of the fastener 64, and an upper inner flange 70, and a recessed portion 72 extending between the lower inner flange 68 and the upper inner flange 70. The lower inner flange 68 is spaced apart from the outer perimeter flange 66, as seen in FIG. 7 so as to form a recess or pocket 74 therebetween. The upper flange 70 is spaced apart from the outer perimeter flange 66 so as to form a shallow pocket 76. A narrow slot or recess 78 is provided between the upper inner flange 70 and the recessed portion 72.

The fastener 64 is intended for use in an appliance wherein the top cover 20A has a lower edge which overlappingly mates with the upper edge of the cabinet 12A. The top cover 20A and the cabinet 12A each have an opening which aligns with one another when the top cover 20A is matingly fit into the cabinet 12A. When the top cover 20A is positioned on the cabinet 12A with the aligned openings, the fastener 64 can be snap fit into the openings so as to retain the top cover 20A on the cabinet 12A. More particularly, after the openings of the top cover 20A and the cabinet 12A are aligned, the pocket 74 formed between the flanges 66 and 68 is positioned over the lower edge of the aligned openings, with the upper inner flange 70 being positioned exteriorly or outside of the cabinet 12A. The upper portion of the fastener 64 is then rotated, as indicated by arrow 80 in an inward direction such that the upper inner flange 70 is deflected downwardly so as to pass through the aligned openings of the top cover 20A and the cabinet 12A. The slot 78 in the fastener 64 allows such deflection of the resilient flange 70. As the flange 70 passes inwardly beyond the opening of the top cover 20A, the flange 70 returns to its non-deflected position. Thus, the handle 64 snap fits into position in the aligned openings of the top cover 20A and the cabinet 12A, thereby securing the top cover 20A to the cabinet 12A.

Thus, the fasteners 26 secure the top cover 20 to the cabinet 12 and also provide handles to facilitate movement of the appliance 12.

Whereas the invention has been shown and described in connection with the preferred embodiments thereof, it will be understood that many modifications, substitutions, and additions may be made which are within the intended broad scope of the following claims. From the foregoing, it can be seen that the present invention accomplishes at least all of the stated objectives.

What is claimed is:

1. A laundry appliance comprising:

a four-sided cabinet with an open top and a pair of openings in opposite side walls thereof;

a top cover adapted to matingly fit within the top of the cabinet;

a pair of fasteners extending through the openings to secure the cabinet and top cover together;

each fastener including a handle to provide a hand grip on the opposite side walls of the cabinet; and each fastener further comprising a screw to secure the handle to the top cover.

2. The laundry appliance of claim 1 wherein the top cover and the handle have overlapping interlocked lips.

3. The laundry appliance of claim 2 wherein the lips of the top cover and handle have opposing surfaces which snap fit together.

4. The laundry appliance of claim 2 wherein the lip of the handle is sandwiched between the lip of the top cover and the cabinet.

5. The laundry appliance of claim 1 wherein each fastener includes an outer peripheral face disposed on an outer surface of the cabinet and the handle includes a recessed portion extending inwardly through one of the pair of openings of the cabinet.

6. The laundry appliance of claim 5 wherein the top cover includes a pair of openings each aligned with one of the pair of openings of the cabinet, and the handle portion extends through the openings of the cabinet and of the top cover.

7. The laundry appliance of claim 5 wherein the fastener includes a boss and the handle portion includes a hole aligned with the boss for receiving a screw to secure the handle to the boss.

8. The laundry appliance of claim 5 wherein the fastener includes a flange face disposed on the inner surface of the cabinet.

9. The laundry appliance of claim 1 wherein the sides of the cabinet reside in a vertical plane and the openings extend horizontally through the sides.

10. An improved laundry appliance having a top cover matable with a lower cabinet member, the improvement comprising:

an opening extending horizontally through a vertical side wall of the cabinet member;

a fastener extending through the opening and being adapted to secure the top cover to the cabinet member; and the fastener including an inner member residing within the cabinet member for attachment to the top cover, and an outer member extending through the opening for attachment to the inner member, the inner and outer members being secured together by a screw.

11. The improved laundry appliance of claim 10 wherein the fastener includes a recessed portion forming a hand grip on the side wall of the cabinet member.

12. A laundry appliance comprising:

a four-sided cabinet with an open top and a pair of openings in opposite side walls thereof;

a top cover adapted to matingly fit within the top of the cabinet;

a pair of fasteners extending through the openings to secure the cabinet and top cover together;

each fastener including a handle to provide a hand grip on the opposite side walls of the cabinet; and the top cover and the handle having overlapping interlocked lips.

13. A laundry appliance comprising:

a four-sided cabinet with an open top and a pair of openings in opposite side walls thereof;

a top cover adapted to matingly fit within the top of the cabinet;

a pair of fasteners extending through the openings to secure the cabinet and top cover together;

each fastener including a handle to provide a hand grip on the opposite side walls of the cabinet; and each fastener including an outer peripheral face disposed on an outer surface of the cabinet and the handle including a recessed portion extending inwardly through one of the pair of openings of the cabinet.

* * * * *